US006570317B1

(12) United States Patent
Takahashi et al.

(10) Patent No.: US 6,570,317 B1
(45) Date of Patent: May 27, 2003

(54) CATHODE-RAY TUBE AND METHOD FOR MANUFACTURING THE SAME

(75) Inventors: Yoshinori Takahashi, Saitama-ken (JP); Hisashi Chigusa, Saitama-ken (JP); Katsuyuki Aoki, Saitama-ken (JP); Hiroyoshi Fukasawa, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/736,019

(22) PCT Filed: Jun. 17, 1999

(86) PCT No.: PCT/JP99/03227

§ 371 (c)(1),
(2), (4) Date: Dec. 19, 2000

(87) PCT Pub. No.: WO99/66527

PCT Pub. Date: Dec. 23, 1999

(30) Foreign Application Priority Data

Jun. 19, 1998 (JP) ..... 10-173474

(51) Int. Cl.[7] ..... H01J 29/10; H01J 29/88
(52) U.S. Cl. ..... 313/479; 313/478; 313/112
(58) Field of Search ..... 313/479, 489, 313/112, 478, 113, 114, 110

(56) References Cited

U.S. PATENT DOCUMENTS

| | | | | |
|---|---|---|---|---|
| 4,563,612 A | | 1/1986 | Deal et al. | 313/478 |
| 4,728,856 A | | 3/1988 | Iwasaki et al. | 313/467 |
| 5,444,329 A | | 8/1995 | Matsuda et al. | 313/479 |
| 5,652,476 A | * | 7/1997 | Matsuda et al. | 313/112 |
| 5,962,966 A | | 10/1999 | Chigusa et al. | 313/479 |
| 6,411,028 B1 | * | 6/2002 | Chigusa et al. | 313/479 |

FOREIGN PATENT DOCUMENTS

| | | |
|---|---|---|
| JP | 57-134848 | 8/1982 |
| JP | 57-134849 | 8/1982 |
| JP | 57-134850 | 8/1982 |
| JP | 3-254049 | 11/1991 |
| JP | 4-067545 | 3/1992 |
| JP | 7-134956 | 5/1995 |
| JP | 61-118946 | 6/1996 |
| JP | 9-076401 | 3/1997 |
| JP | 9-086967 | 3/1997 |

OTHER PUBLICATIONS

M. Onodera, et al., SID 94 Digest, pps. 823–826, "A Color Display Tube with a High–Contrast and AntiReflection Coating," 1994.

* cited by examiner

*Primary Examiner*—Don Wong
*Assistant Examiner*—Thuy Vinh Tran
(74) *Attorney, Agent, or Firm*—Oblon, Spivak, McClelland, Maier & Neustadt, P.C.

(57) ABSTRACT

A cathode ray tube has, on an external surface of a face-panel, an anti-reflection film in which a layer mainly consisting of $SiO_2$ is laminated on a transparent conductive layer that includes at least one of colored ITO and colored ATO, and a coloring matter that has a color that is a complementary color with respect to the colors of ITO and/or ATO. As the colored ITO and/or colored ATO, one that has a particle diameter of from 10 to 500 nm is employed. In addition, as the coloring matter, a dyestuff that has the maximum absorption in the wavelength range of 550 to 600 nm or the like is employed. Value of surface resistance of the anti-reflection film is preferable to be $1\times10^6$ Ω/sq or less. A cathode ray tube having such an anti-reflection film can prevent effectively AEF from occurring and realize an improved contrast and comfortable body color.

19 Claims, 4 Drawing Sheets

CATHODE-RAY TUBE AND METHOD FOR MANUFACTURING THE SAME

TECHNICAL FIELD

The present invention relates to a cathode ray tube that, on an external surface of a face-panel thereof, has an anti-reflection film of an excellent leakage electromagnetic wave shielding effect and of optimized contrast. Further, the present invention relates to an efficient manufacturing method of cathode ray tubes having an anti-reflection film that is highly effective in shielding the leakage electromagnetic wave.

BACKGROUND ART

A color cathode ray tube that is used for TV Braun tube, computer display terminal or the like has, on an inner surface of a front panel (face-panel) of a face-plate, phosphor layers consisting of blue-emitting phosphor (B), green-emitting phosphor (G) and red-emitting phosphor (R), respectively. All of the respective phosphor layers are disposed in a prescribed pattern of dot or stripe. By bombarding the respective phosphor layers by an electron beam, the phosphors emit respective colors to display image.

Such cathode ray tubes are used under an ambient light. Therefore, an anti-reflective surface treatment film (anti-reflection film) is disposed on an external surface of the face-panel by laminating a multiple number of layers of different refractive index thereon (in general, bottom layer that is close to a face-panel is designated as a layer of high refractive index, and upper layer that is distanced far from the face-panel is designated to a layer of low refractive index). Respective lights reflected at respective boundaries of the layers of anti-reflection film interfere each other to cancel out.

In the cathode ray tubes having such an anti-reflection film, in order to improve the following characteristics thereof, various ideas have been proposed.

First of all, improvement of display contrast is being demanded. For improving the contrast, there is one method in which light transmittance of the face-panel is lowered to obtain a flat transmitting characteristic. However, this method reduces the brightness of the phosphors as well as superposition of the ambient light. Accordingly, this is not a desirable method.

Further, there are proposed several applications that employ neodymium oxide ($Nd_2O_3$) included in a face-panel itself as filter material (cf. U.S. Pat. No. 4,728,856, Japanese Patent Laid-Open Publication (KOKAI) No. Sho 57-134848, Japanese Patent Laid-Open Publication (KOKAI) No. Sho 57-134849 and Japanese Patent Laid-Open Publication (KOKAI) No. Sho 57-134850). Neodymium oxide ($Nd_2O_3$) has a selective absorption characteristic of visible light (the maximum absorption is shown in the range of wavelength of from 560 to 615 nm and the second maximum absorption is shown in the range of wavelength of from 490 to 545 nm). Accordingly, it can selectively absorb the ambient light to realize improvement of the contrast.

However, the face-panel including neodymium oxide shows BCP value (Brightness Contrast Performance) of from 1 to 1.05 and did not show a sufficient improvement of the contrast.

Here, the BCP is one of the indices that express the display contrast and shows a degree of deviation of the contrast from a reference. When the rate of deviation of the brightness from a reference is $\Delta B$ and reflectivity of the ambient light is $\Delta R_f$, the BCP is expressed by $$BCP=\Delta B/\sqrt{\Delta R_f}$$

Secondly, an anti-static measure is implemented on the surface of the face-panel. When the static is built up on the surface of the face-panel, dust or dirt adheres thereon. Accordingly, to prevent the static from building up, a conductive film is formed on the external surface of the face-panel. For example, U.S. Pat. No. 4,563,612 discloses a method in which a film including silicate and conductive metal is formed on the external surface of the face-panel, and Japanese Patent Laid-Open Publication (KOKAI) No. Sho 61-118946 or the like discloses a method in which silicon alcoholate is coated by spray method to form an anti-static film.

Thirdly, an anti-leakage measure against the generated Alternating Electric Field (AEF) is implemented. Recently, in cathode ray tubes such as TV Braun tubes or display terminals of computers, there is a concern that AEF generated in the neighborhood of an electron gun and deflection yokes disposed inside the cathode ray tube leaks outside thereof to adversely affect electronic instruments or human bodies in the surroundings thereof. In particular, in Europe, there is a movement to standardize TCO guideline (a guideline due to The Swedish Central Organization of Salaried Employees) for preventing the AEF from occurring.

As an anti-leakage measure of AEF, there is an idea to lower the value of surface resistance of the anti-reflection film formed on the external surface of the face-panel. As such an anti-reflection film of low resistance (conductive), various kinds of surface treatment films have been developed.

With surface treatment films that have been conventionally employed in cathode ray tube, characteristics such as display contrast and anti-reflection effect (low reflectivity), and lowness of the value of surface resistance (low resistivity) and so on are shown in Table 1. Incidentally, whether the anti-reflection effect is acceptable or not is judged based on the values of specular reflectance (Rlum%) and specular reflection chromaticity (color x/y) that are indices of anti-reflectivity. Incidentally, the specular reflectance means a product of a spectral reflectance of a regularly reflected light (that is, light of angle of reflection of 15°) of an incident light with an angle of incidence of 15° that is shown in FIG. 5 and a luminosity curve. When this value is 1.5% or less, it is judged to have an excellent anti-reflection effect.

Further, specular reflection chromaticity is the chromaticity of the specular reflection light that is shown in FIG. 5 and is required to be color of reflection that does not give uncomfortableness. It is required for its x-coordinate in chromaticity diagram to locate in the range of $0.170 \leqq x \leqq 0.330$ and for its y-coordinate to have value in the range of $0.170 \leqq y \leqq 0.330$. When any one of x and y coordinates deviates from the above values, the reflected light gives an uncomfortable feeling.

TABLE 1

| Surface Treatment Film | | A | B | C | D | E | F | G | H |
|---|---|---|---|---|---|---|---|---|---|
| Dyestuff | | yes | yes | none | none | none | yes | yes | yes |
| its kind | | a | b | | | | a | a | a |
| Number of layers | | 1 | 2 | 2 | 3 | 1 | 2 | 2 | 2 |
| Type of film of upper layer | | smooth film | smooth silica film | smooth silica film | smooth film + coarse film | coarse silica film | smooth silica film | smooth silica film | smooth silica film |
| Conductive matter | | non-colored Li nitrate | non-colored ATO | colored ITO | colored ITO | non-colored ITO | non-colored ITO | non-colored ATO | colored Ag |
| BCP | | improved | no change | no change | no change | deteriorated | improved | improved | deteriorated |
| AR | Rlum % | insufficient | good | good | good | insufficient | good | good | good |
| | Color | uncomfortable | comfortable | comfortable | comfortable | uncomfortable | comfortable | comfortable | comfortable |
| AEF-TCO | | inconformity | inconformity | conformity with circuit correction | conformity with circuit correction | inconformity | inconformity | inconformity | conformity |
| Resolution | | good | good | good | good | bad | good | good | good |

In the row showing the kinds of dyestuffs, sign a denotes a dyestuff having a selective absorption at the wavelength of 575 nm such as Rhodamine B, and sign b denotes a dyestuff having a flat and non-selective absorption in the visible light region such as carbon black.

However, as shown in Table 1, there has not been obtained yet a surface treatment film that combines three major characteristics of high contrast, low reflectivity and low surface resistance corresponding to the TCO guideline, and further combines smoothness and high reliability.

That is, in a smooth and low reflection film of two layered structure in which an upper layer mainly consisting of $SiO_2$ is laminated on a transparent conductive bottom layer containing non-colored conductive matter such as non-colored ITO (Indium doped Tin Oxide) or non-colored ATO (Antimony doped Tin Oxide), when surface treatment films (F and G in table 1) in which a dyestuff (coloring matter) that has the selective absorption in the visible wavelength region that can improve the contrast is further included in the bottom layer, the value of surface resistance goes up and can not satisfy the TCO guideline. Further, when the content of the conductive matter in the bottom layer is increased to satisfy the TCO guideline, that hazes the film to induce a phenomenon that the image looms up white and deteriorate the contrast.

Further, an anti-reflection film that contains a colored conductive matter such as silver in the bottom layer does not necessarily have a selective absorption in the desired visible wavelength region (in the neighborhood of 550 nm), accordingly the contrast can not be expected to improve. When further trying to mix a coloring matter that has a selective absorption that can improve the contrast, the transmittance of the film itself decreases to make unable to secure enough brightness.

The present invention is carried out to solve these problems. An objective of the present invention is to provide a cathode ray tube provided with an anti-reflection film that has such a low surface resistance that is effective in suppressing the AEF and corresponding to the TCO guideline, an improved contrast, and a natural and comfortable body color (reflection color of scattered light, namely shade of reflected light when the display is turned off).

Another object of the present invention is to provide a manufacturing method of cathode ray tubes that have an anti-reflection film that has such a low surface resistance and is improved in the contrast thereof or the like.

DISCLOSURE OF THE INVENTION

The first aspect of the present invention is a cathode ray tube, the cathode ray tube comprising a light transmissible panel, an anti-reflection film that is disposed on an external surface of the panel and has a structure in which two or more layers are laminated, and phosphor layers disposed on an internal surface of the panel. Here, the anti-reflection film has at least one transparent conductive layer and this transparent conductive layer includes at least one of colored ITO (Indium doped Tin Oxide) and colored ATO (Antimony doped Tin Oxide), and a coloring matter that has a complementary color with respect to the colors of the ITO and/or the ATO, and a upper layer mainly consisting of $SiO_2$ is disposed directly or through an intermediate layer on this transparent conductive layer.

The second aspect of the present invention is a manufacturing method of cathode ray tubes, the manufacturing method comprising a step of coating a dispersion liquid that includes at least one of the colored ITO and colored ATO, and a coloring matter that has a complementary color with respect to the colors of the ITO and/or the ATO directly or through an underlying layer on an external surface of a light transmissible panel and forming a bottom coating film; a step of coating a dispersion liquid mainly consisting of an alkoxide of silica directly or through another layer on the bottom coating film and forming a upper coating film; and a step of heating and curing the bottom coating film and the upper coating film, or burning.

In the anti-reflection film that is disposed on the external surface of the face-panel of the cathode ray tube of the present invention, the bottom transparent conductive layer contains the colored ITO and/or colored ATO with respectively appropriate ratio with respect to a coloring matter (dyestuff) that has a complementary color with respect to the above mentioned colored ITO and/or colored ATO. Accordingly, it is less reflective and has less superposition of the ambient light, and is improved in the contrast and surface resistance that is enough low to satisfy the TCO guideline.

Here, the value of surface resistance of the anti-reflection film is, considering the response to the TCO guideline, preferable to be set at $1\times10^6$ Ω/sq or less, and further preferable to be set at $1\times10^4$ Ω/sq or less. Incidentally, this value of surface resistance is a sheet resistance (surface resistivity) and is measured according to JIS (Japanese Industrial Standard) K-6911.

In addition, the colored ITO and/or colored ATO is included in the transparent conductive layer of the bottom layer, and these colored ITO and colored ATO have colors complementary to color of the coloring matter that is compounded to improve the contrast. Therefore, natural and comfortable body color can be realized. Accordingly, in order to adjust the body color, another coloring matter is not required to compound further in the transparent conductive layer. Further, since on such a transparent conductive layer a smooth upper layer mainly consisting of $SiO_2$ is disposed, a high resolution can be obtained.

In the following, the present invention will be described in more detail.

In the present invention, as shown in FIG. 1, on an external surface of a light transmissible panel 1 such as a glass panel, directly or through another layer (an underlying layer), a transparent conductive layer 2 is disposed. On this transparent conductive layer 2 directly or through another layer (an intermediate layer), an upper layer 3 mainly consisting of $SiO_2$ is disposed. Then, this upper layer 3 and the transparent conductive layer 2 are laminated to form an anti-reflection film 4. The ratio of thicknesses of the transparent conductive layer 2 that is a bottom layer and the upper layer 3 mainly consisting of $SiO_2$ is not particularly restricted, but is preferable to be in the range of from 40:60 to 60:40.

The transparent conductive layer 2 that is a bottom layer constituting an anti-reflection film 4 contains at least one of the colored ITO and colored ATO, and a coloring matter (dyestuff) that has a color complementary to colors of these colored conductive matters. When both the colored ITO and colored ATO are mixed together to employ, the mixing ratio thereof is not particularly restricted and can be set freely.

Here, the colored ITO and colored ATO are conductive matters that are particulate and bluish in their colors. As commercial products of such dispersion liquid that contains such colored ITO or colored ATO, for example ARS-21A or ARS-11A (both are product names of Asahi Glass Co.) can be cited.

As such colored ITO and colored ATO, it is particularly desirable to employ particles of particle diameter (primary particle diameter) in the range of from 10 to 500 nm. When the particles of the particle diameter of the aforementioned range are employed, a burned coating film shows a bluish color close to that of the particles. Accordingly, by combining with a coloring matter that will be described later, a natural and practically comfortable body color can be realized.

The colored ITO and colored ATO are preferable to be contained in the range of from 90 to 99% by weight with respect to the total solid component of the bottom layer. When the content of the colored ITO and colored ATO is less than 90% by weight, the value of surface resistance of the anti-reflection film becomes too high to satisfy the TCO guideline. On the contrary, when the content of the colored ITO and colored ATO exceeds 99% by weight, the value of BCP becomes too low to improve the contrast. Further, its body color becomes strongly bluish to be practically uncomfortable.

As the coloring matter, dyestuffs or pigments that have the maximum absorption in the visible wavelength range of 550 to 600 nm are preferable to employ. As dyestuffs having such a selective absorption, for example, Acid Rhodamine B, Rhodamine B, Kayanol, Milling Red 63W (the names of products of Nihon Kayaku Co.) or the like can be cited. The particle diameter of such coloring matters can preferably maintain, by making smaller than those of the colored ITO and colored ATO, sufficient conductivity of the film. Such a coloring matter is preferable to be included with a ratio of from 1 to 10% by weight with respect to the total bottom layer. When the content of the coloring matter is less than 1% by weight, the body color becomes strongly bluish and is not acceptable. On the contrary, when the content exceeds 10% by weight, the value of the surface resistance becomes too high to satisfy the TCO guideline.

Incidentally, the bottom layer (transparent conductive layer) of such an anti-reflection film can include, other than such coloring matter and the aforementioned colored ITO and/or colored ATO, $SiO_2$or $ZrO_2$, $TiO_2$ or the like as a binder.

In the present invention, on such a transparent conductive layer, directly or through another intermediate layer, a upper layer of low refractive index mainly consisting of $SiO_2$ is disposed. This upper layer can include, other than $SiO_2$ that is the main component thereof, ITO and/or ATO in the range that does not so much deteriorate the strength of the film. As the ITO and ATO, it is preferable to employ the colored ITO and/or colored ATO. However, non-colored ITO and non-colored ATO also can be employed.

In a cathode ray tube that has an anti-reflection film of which upper layer mainly consisting of $SiO_2$ contains ITO and/or ATO, the surface of the face-panel can be electrically grounded at ease. In particular, one that has an anti-reflection film containing the colored ITO or the like can further improve the display contrast.

Incidentally, such a upper layer can contain, other than the aforementioned ITO and/or ATO, alkylsilane derivatives such as alkylsilane and fluoro-alkylsilane in the ratio of from 0.01 to 10% by weight. In addition, a protective layer consisting of silica coupling matter or silicone can be further disposed on such a upper layer to improve the strength of the film.

In the present invention, an anti-reflection film in which the aforementioned transparent conductive layer and the upper layer mainly consisting of $SiO_2$ are laminated is preferably formed by the use of the following wet method. In this method, firstly, the aforementioned colored ITO and/or colored ATO and the coloring matter are agitated enough in a solvent mainly consisting of alcohol such ethanol or 2-propanol to prepare a dispersion liquid. At this time, the particle diameter of the coloring matter is preferable to be made smaller than that of the ITO or the like, so that the coloring matter does not to interfere the conductivity of the ITO and ATO.

Next, the obtained dispersion liquid is coated by a known coating method such as spin coating method, spray coating method, roll coating method, bar coating method or the like directly or through another layer (underlying layer) on the external surface of the face-panel that is polished by the use of cerium oxide and cleansed. Thus, a bottom coating film is formed.

Then, on this bottom coating film, a dispersion liquid having ethanol or 2-propanol as a solvent, that contains an alkoxide of silica as the main component is coated by the use of known coating method such as spin coating method, spray coating method, roll coating method, bar coating method or the like to form an upper coating film. Here, when the spin coating method is employed to form the upper coating film, a smooth film can be formed and high resolution can be obtained.

Thereafter, a laminated layer of the upper coating film and the bottom coating film is heated to dry and cure or burn simultaneously both the upper coating film and the bottom coating film. Thus, the transparent conductive layer including the colored ITO or the like and the upper layer mainly consisting of $SiO_2$are laminated to form an anti-reflection film.

In a method that dries and cures or burns simultaneously the upper coating film and the bottom coating film, on the surface of the bottom coating film the dispersion liquid for the upper layer soaks to form a mixed layer between the upper coating film and the bottom coating film. Then, by drying and curing and burning these laminated coat films, between the bottom layer of a transparent conductive layer and the upper layer mainly consisting of $SiO_2$, an intermediate layer is formed and the peeling resistance of the upper layer is improved.

The cathode ray tube of the present invention is a color cathode ray tube that has, on an external surface of a face-panel, an anti-reflection film that is formed by laminating a transparent conductive layer including colored ITO or the like and a upper layer mainly consisting of $SiO_2$, and has, for example, the following structure.

That is, this cathode ray tube, as shown in FIG. 2, has an envelope consisting of a light transmissible panel 1 such as a glass panel, a funnel 5 and a neck 6. On the external surface of the panel 1, the aforementioned anti-reflection film 4 is disposed. In addition, on the internal surface of the panel 1, a phosphor screen 7 that will be described later is disposed, and further inside thereof there is disposed a shadow mask 8 opposite to the phosphor screen 7. On the other hand, inside the neck 6 of the envelope, there is disposed an electron gun 10 that emits an electron beam 9. Further, inside of the funnel 5 there is disposed an inner shield 11 for shielding the electron beam 9 emitted from the electron gun 10 from an external magnetic field. Outside of the funnel 5, there is disposed a deflection yoke 12 for deflecting the electron beam 9 through a generated magnetic field.

The phosphor screen 7, as shown in FIG. 3, is constituted of a light absorbing layer 13 formed in matrix, and the respective phosphor layers 14B, 14G and 14R of blue color, green color and red color that are arranged and formed regularly in holes of a prescribed shape (for example, in circular dot) of the light absorption layer 13. In order to improve color purity, between the phosphor layer 14 and the panel 1, there is interposed an optical filter layer 15 that has pigment layers 15B, 15G and 15R of respective colors of blue, green and red corresponding to emission colors of the phosphor layer 14.

In a color cathode ray tube that has such an optical filter layer 15, when the aforementioned anti-reflection film is disposed on the external surface of the face-panel, due to the colored ITO and/or colored ATO contained in the bottom layer (transparent conductive layer) of the anti-reflection film, the red color of which brightness is larger than those of blue and green colors is suppressed and relaxed, thereby the display that satisfies the condition of balanced brightness can be realized.

MODES FOR CARRYING OUT THE INVENTION

Figure 1:
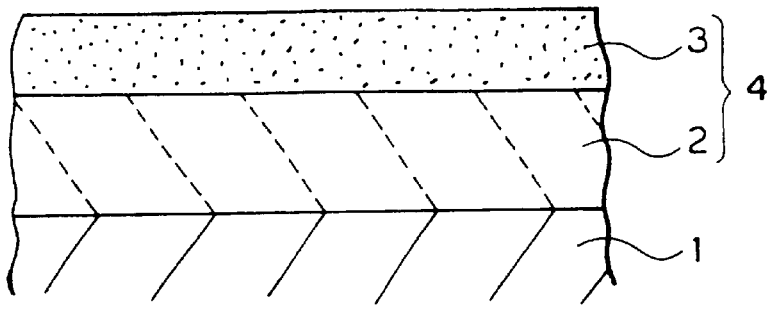
FIG. 1 is a cross-section showing a structure of an anti-reflection film of a cathode ray tube of the present invention.
Figure 2:
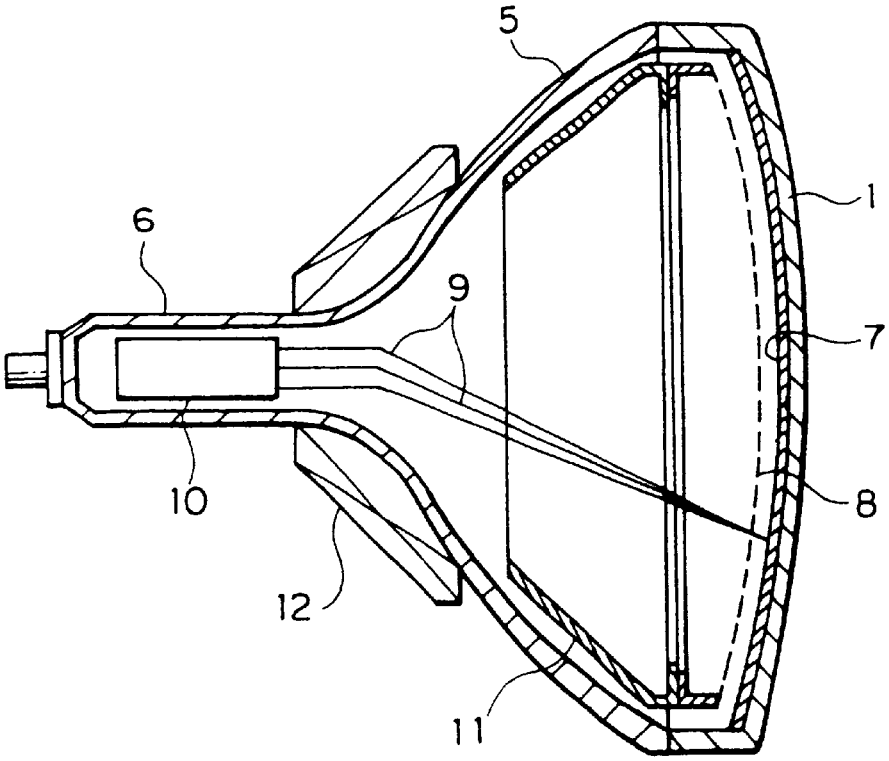
FIG. 2 is a cross-section showing a schematic constitution of a cathode ray tube of the present invention.
Figure 3:
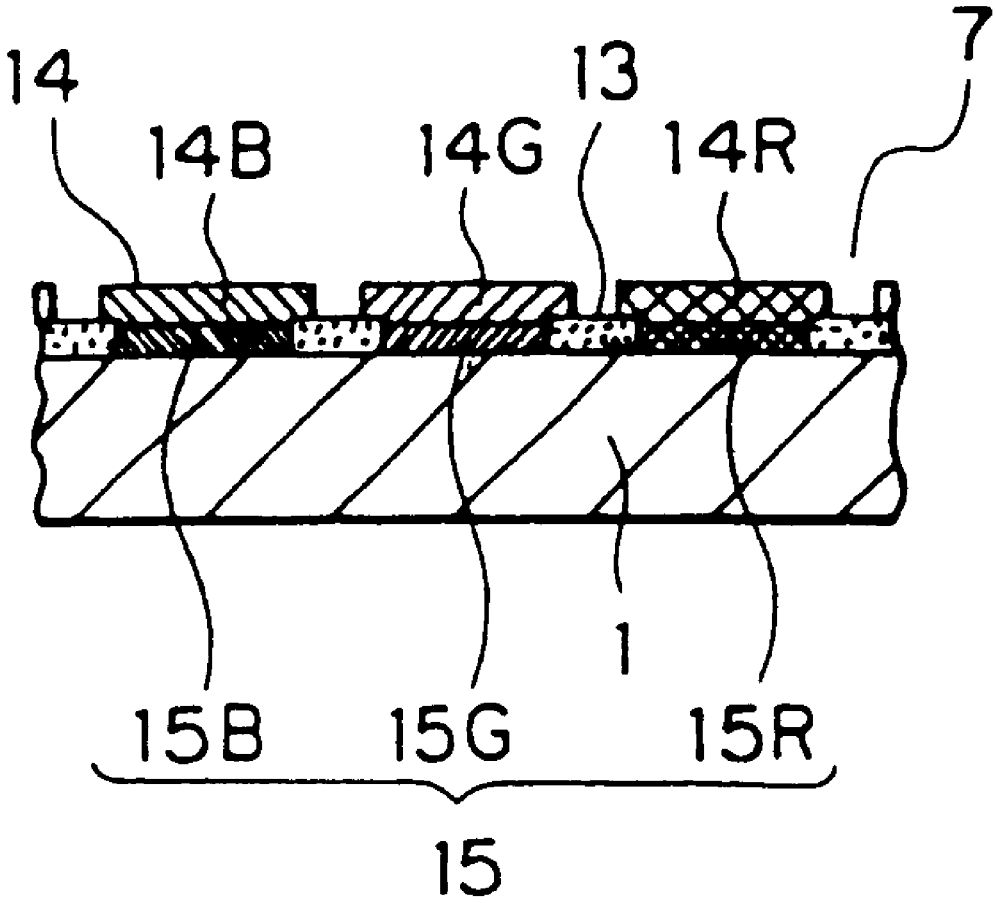
FIG. 3 is a cross-section showing one example of a constitution of a phosphor screen of a cathode ray tube of the present invention.

In the following, the preferred embodiments of the present invention will be described. Incidentally, the present invention is not restricted to the following embodiments.

Embodiments 1 to 5

First, on the inside of a face-panel (17-inch panel) of a cathode ray tube, with the following method a light absorption layer (black matrix layer) and an optical filter layer are formed, respectively, and thereon phosphor layers are formed.

That is, on the inside of a 17-inch glass panel, a photo-resist layer is coated, and the photo-resist layer is exposed through a shadow mask, developed and dried. Thereafter, on a portion where a pigment layer and a phosphor layer that will be described later are being formed, a resist pattern is formed in stripe. After that, over the whole surface thereon, a water dispersion liquid mainly consisting of graphite is coated, dried and bound with a heater to form a coating film in black. Then, the resist layer is dissolved and peeled with hydrogen peroxide water. Thereby, the coating film in black formed on the resist layer is detached and removed to form a light absorption layer in stripe.

Next, as described above, on the inside of the glass panel on which a light absorption layer is formed, an optical filter layer in which a blue pigment layer consisting of cobalt aluminate, a green pigment layer consisting of cobalt green and a red pigment layer consisting of iron oxide red are arranged in stripe is formed with a known method.

Then, on the optical filter layer thus formed, phosphor layers of the respective colors are formed in turn by an ordinary slurry method so that the blue phosphor layer is disposed on the blue pigment layer, the green phosphor layer on the green pigment layer, and the red phosphor layer on the red pigment layer. Incidentally, a slurry of blue phosphor is prepared by mixing and stirring 100 g of blue emitting phosphor (ZnS:Ag, Al), 5 g of polyvinyl alcohol (PVA), 0.30 g of ammonium dichromate (ADC), 0.01 g of surfactant, and 140 g of pure water. A slurry of green phosphor is prepared by mixing and stirring 100 g of green emitting phosphor (ZnS: Cu, Al), 8 g of polyvinyl alcohol, 0.40 g of ammonium dichromate, 0.01 g of surfactant, and 160 g of pure water. Further, a slurry of red phosphor is prepared by mixing and stirring 100 g of red emitting phosphor ($Y_2O_2S$:Eu), 10 g of polyvinyl alcohol, 0.50 g of ammonium dichromate, 0.01 g of surfactant, and 190 g of pure water. These slurries are employed for preparation of the phosphor screen.

Next, coating liquids for the bottom and upper layers to form a surface treatment film are prepared, respectively. First, as the coating liquid for the bottom layer, ethanol dispersion liquids that include at least one of the colored ITO and colored ATO and a coloring matter including Rhodamine B or the like that has the maximum absorption at the wavelength of 575 nm in the ratio shown in Table 2, respectively, and partially hydrolyzed compound of methyl-silicate as the other component are prepared. Further, as the coating liquid for the upper layer, a dispersion liquid mainly consisting of an alkoxide of silica and further containing the colored ITO or the colored ATO in the ratio of 0.1% by weight is prepared. For example, ethanol, 2-propanol or the like can recited, as a dispersion liquid.

Then, the external surface of the face-panel (17-inch panel) of the cathode ray tube is, after assemblage, buffed with cerium oxide powder to remove dust, dirt, oily substance or the like. Thereafter, the aforementioned coating liquid for the bottom layer is coated by the use of spin coating method to form a bottom coating film of a thickness of 0.1 to 0.2 $\mu$m. Then, on this bottom coating film, a coating liquid for the upper layer is coated by the use of the spin coating method to form a film of a thickness of about 0.1 to 0.2 $\mu$m. Thereafter, the coating film consisting of the upper and bottom layers is burned at 210° C. for 30 min to form a smooth surface treatment film.

In addition, for the comparison purpose, by dissolving, in the place of the colored ITO, non-colored ITO and non-colored ATO and fine particles of silver compounds ($Ag_2O$, $AgNO_3$, AgCl or the like) in water, respectively, coating liquids for a bottom layer are prepared. With these coating liquids for a bottom layer, the smooth surface treatment films are formed as identically as the embodiments.

Figure 4:
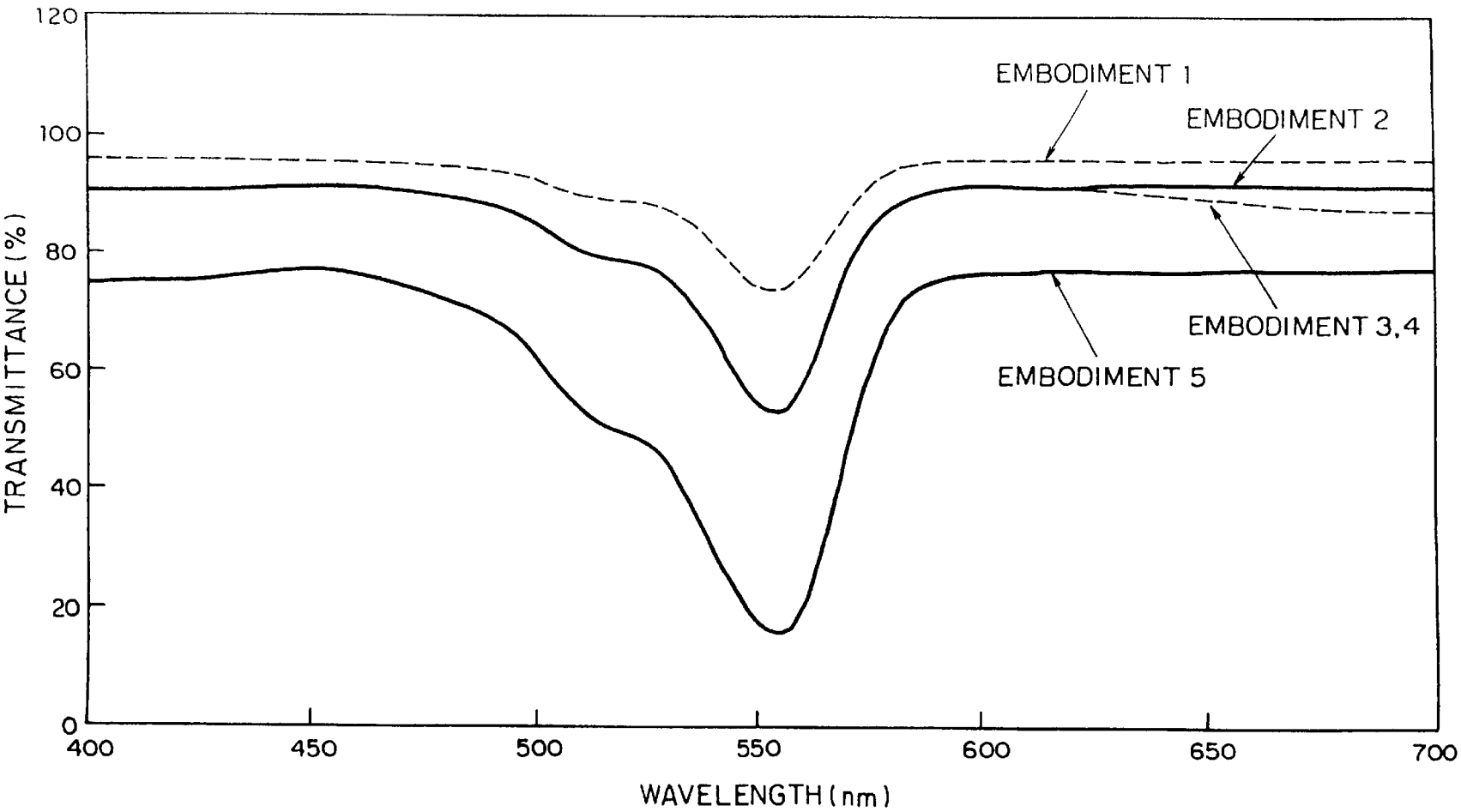
FIG. 4 is a diagram showing experimental results of transmittance characteristic of visible light for surface treatment films obtained in example 1 to 4, respectively.
Figure 5:
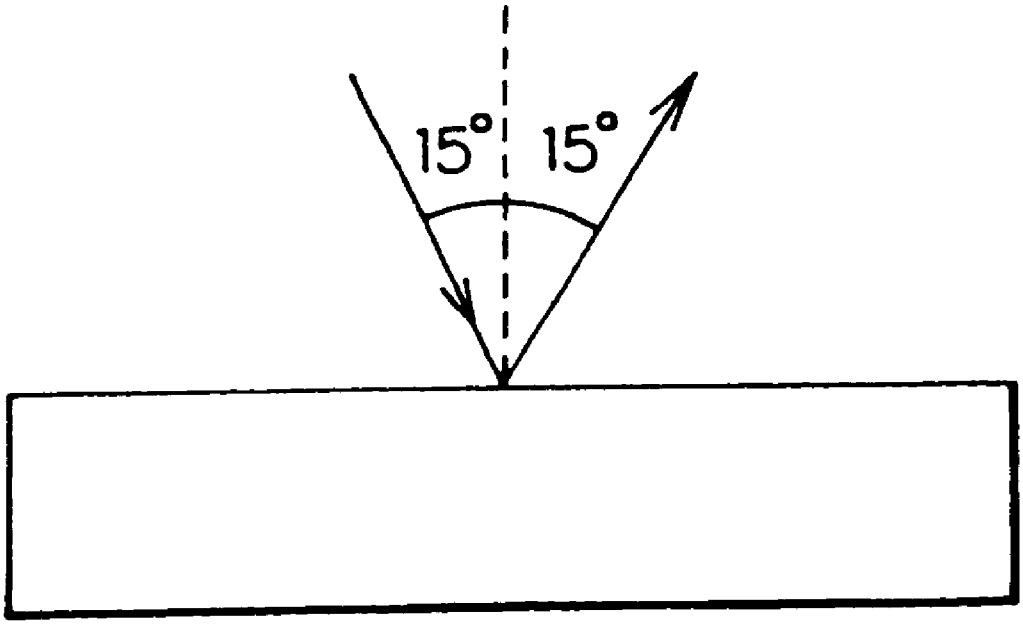
FIG. 5 is a diagram showing a method for measuring a specular reflectance rate (Rlum%) and specular reflection chromaticity (Color x/y).

Next, with the surface treatment films obtained in embodiments 1 and 2, light transmittance of the respective wavelengths are measured to obtain the light transmittance of the visible light. The measured results are shown in FIG. 4. Further, with the surface treatment films obtained in embodiments 1 through 5 and comparative examples 1 through 3, the values of BCP, body colors, anti-reflectivity, conformity to the TCO guideline, and resolution (smoothness) are evaluated. These results are shown in the bottom rows of Table 2.

TABLE 2

| | | Embodiment | | | | | Comparative Example | | |
|---|---|---|---|---|---|---|---|---|---|
| | | 1 | 2 | 3 | 4 | 5 | 1 | 2 | 3 |
| Content in the bottom layer | Dyestuff (wt %) | 1.6 | 3.3 | 3.3 | 3.3 | 9.5 | 3.3 | 3.3 | 3.3 |
| | Conductive matter (wt %) | colored ITO, 92.6 | colored ITO, 92.6 | colored ATO, 92.6 | colored ITO + colored ATO, 46.3 + 46.3 | colored ITO, 90.0 | non-colored ITO, 92.6 | non-colored ATO, 92.6 | colored Ag, 92.6 |
| BCP value | | 1.00 | 1.06 | 1.07 | 1.07 | 1.12 | 1.04 | 1.04 | 0.96 |
| Body color | | approximately good, slightly bluish | good | good | good | good | bad, reddish | bad, reddish | bad, reddish |
| AR | Rlum % | good | good | good | good | good | good | good | good |
| | Color | comfortable | comfortable | comfortable | comfortable | comfortable | comfortable | comfortable | comfortable |
| AEF-TCO | | conformity | conformity corrected by circuit | conformity corrected by circuit | conformity corrected by circuit | conformity | conformity | conformity | conformity |
| Resolution | | good | good | good | good | good | good | good | good |

As obvious from Table 2, all of the surface treatment films obtained in embodiments 1 through 5 have the low values of surface resistance that are effective for preventing the AEF from occurring and satisfy the TCO guideline. In addition, compared with the case where such a treatment is not implemented, the display contrast is improved. Further, it is excellent in anti-reflective property and has a natural and comfortable body color.

On the other hand, the surface treatment films obtained in comparative examples 1 and 2 employ as the conductive matter, instead of the colored ITO or colored ATO, the non-colored ITO or non-colored ATO. Since these are contained in the bottom layer together with the coloring matter, the body colors of the surface treatment films are tinted reddish. It is not only practically unfavorable but also since the BCP values are low, the display contrasts are deteriorated.

Industrial Applicability

As obvious from the above description, according to the present invention, an anti-reflection film that has low surface resistance in effective for preventing the AEF from occurring and is suppressed effectively in the reflection of the ambient light can be obtained. In addition, a cathode ray tube that has an anti-reflection film with the improvement of the contrast, of a comfortable and natural body color and of ambient light reflection suppressed effectively can be realized.

What is claimed is:

1. A cathode ray tube, comprising:

a light transmissible panel;

an anti-reflection film that is disposed on an external surface of the panel and has a structure in which two or more layers are laminated; and phosphor layers disposed on an internal surface of the panel;

wherein the anti-reflection film has at least one transparent conductive layer, and this transparent conductive layer includes at least one of colored ITO (Indium doped Tin oxide) and colored ATO (Antimony doped Tin Oxide), and a coloring matter that has a complementary color with respect to the colors of the ITO and/or the ATO, over this transparent conductive layer an upper layer mainly consisting of $SiO_2$ is disposed, and a value of surface resistance of the anti-reflection film is $1\times10^6$ Ω/sq or less.

2. The cathode ray tube as set forth in claim 1, wherein value of surface resistance of the anti-reflection film is $1\times10^4$ Ω/sq or less.

3. The cathode ray tube as set forth in claim 1, wherein the colored ITO and the colored ATO are particulate and a particle diameter of the colored ITO and/or the colored ATO is in the range of from 10 to 500 nm.

4. The cathode ray tube as set forth in claim 1, wherein the coloring matter has the maximum absorption in the wavelength region of from 550 to 600 nm.

5. The cathode ray tube as set forth in claim 1, wherein the transparent conductive layer includes at least one of the colored ITO and the colored ATO in a proportion of 90 to 99% by weight thereof.

6. The cathode ray tube as set forth in claim 1, wherein the transparent conductive layer includes the coloring matter in a proportion of from 1 to 10% by weight thereof.

7. The cathode ray tube as set forth in claim 6, wherein the transparent conductive layer includes the coloring matter in a proportion of from 3 to 10% by weight thereof.

8. The cathode ray tube as set forth in claim 1, wherein a ratio of thickness of the transparent conductive layer and thickness of the upper layer is in the range of from 40:60 to 60:40.

9. The cathode ray tube as set forth in claim 1, wherein the transparent conductive layer further includes at least one compound selected from $SiO_2$, $ZrO_2$ and $TiO_2$.

10. The cathode ray tube as set forth in claim 1, wherein the upper layer further includes at least one of ITO and ATO.

11. The cathode ray tube as set forth in claim 10, wherein the upper layer includes at least one of colored ITO and colored ATO.

12. The cathode ray tube as set forth in claim 11, wherein the cathode ray tube has, between an internal surface of the panel and the phosphor layer, an optical filter layer that transmits only a light of a desired wavelength corresponding to an emission color of the phosphor.

13. A manufacturing method of a cathode ray tube, comprising:

coating a first dispersion liquid that includes at least one of colored ITO and colored ATO, and a coloring matter that has a complementary color with respect to the colors of the ITO and/or the ATO directly or through an underlying layer on an external surface of a light transmissible panel, and forming a bottom coating film;

coating a second dispersion liquid mainly consisting of an alkoxide of silica directly or through another layer on the bottom coating film, and forming an upper coating film; and heating and curing or burning the bottom coating film and the upper coating film respectively to form an anti-reflection film having a value of surface resistance of $1\times10^6$ Ω/sq or less.

14. The manufacturing method of a cathode ray tube as set forth in claim 13, wherein a particle diameter of the colored ITO and/or the colored ATO is in the range of from 10 to 500 nm.

15. The manufacturing method of a cathode ray tube as set forth in claim 13, wherein the coloring matter has the maximum absorption in the wavelength range of from 550 to 600 nm.

16. The manufacturing method of a cathode ray tube as set-forth in claim 13, wherein ratio of thicknesses of the bottom coating film and the upper coating film is in the range of from 40:60 to 60:40.

17. The manufacturing method of a cathode ray tube as set forth in claim 13, wherein the bottom coating film further includes a component that generates at least one compound selected from $SiO_2$, $Zro_2$, and $TiO_2$.

18. The manufacturing method of a cathode ray tube as set forth in claim 13, wherein the upper coating film further includes at least one of ITO and ATO.

19. The manufacturing method of a cathode ray tube as set forth in claim 13, wherein a ratio of the coloring matter to the colored ITO and colored ATO in the bottom coating film is from 1.7 to 10.6% by weight.

* * * * *